US005186445A

United States Patent [19]

Nakanishi et al.

[11] Patent Number: 5,186,445

[45] Date of Patent: Feb. 16, 1993

[54] SHEET HANDLING APPARATUS, WITH SHEET STORAGE BINS CONVEYABLE IN A VERTICLE AND A LATERAL DIRECTION

[75] Inventors: Tsugio Nakanishi, Osaka; Yoichiro Irie, Suita; Tsuyoshi Nagao, Osaka, all of Japan

[73] Assignee: Mita Industrial Co., Ltd., Japan

[21] Appl. No.: 780,297

[22] Filed: Oct. 22, 1991

[30] Foreign Application Priority Data

Oct. 29, 1990 [JP] Japan ..... 2-292771

[51] Int. Cl.[5] ..... B42B 2/00; B65H 39/02

[52] U.S. Cl. ..... 270/053; 270/58

[58] Field of Search ..... 270/37, 53, 58

[56] References Cited

U.S. PATENT DOCUMENTS

| | | | |
|---|---|---|---|
| 4,320,854 | 3/1982 | Hirose | 271/245 X |
| 4,361,393 | 11/1982 | Noto | 270/58 X |
| 4,376,529 | 3/1983 | George et al. | 270/53 |
| 4,410,170 | 10/1983 | Wertheimer et al. | 270/37 |
| 4,479,641 | 10/1984 | Bean et al. | 270/53 |
| 4,552,497 | 11/1985 | Kockler et al. | 270/53 X |
| 4,746,111 | 5/1988 | Naramore | 270/58 X |
| 4,925,171 | 5/1990 | Kramer et al. | 270/52 X |
| 5,029,831 | 7/1991 | Green | 270/53 |
| 5,088,709 | 2/1992 | Yamamoto | 270/52 X |
| 5,110,102 | 5/1992 | Suzuki et al. | 270/53 |
| 5,112,035 | 5/1992 | Yamamoto et al. | 270/53 |
| 5,114,130 | 5/1992 | Hamanaka et al. | 270/53 |
| 5,121,911 | 6/1992 | Yamazaki et al. | 270/53 |
| 5,129,640 | 7/1992 | Kosaka et asl. | 270/53 |

FOREIGN PATENT DOCUMENTS

| | | | |
|---|---|---|---|
| 046674 | 3/1982 | European Pat. Off. . | |
| 046675 | 3/1982 | European Pat. Off. . | |
| 3619800 | 6/1986 | Fed. Rep. of Germany . | |
| 0233296 | 9/1990 | Japan | 270/53 |

OTHER PUBLICATIONS

Patent Abstracts of Japan, vol. 13, No. 559 (M-905), Dec, 12, 1989; & JP-A-1 231 757 (CANON) Sep. 18, 1989.

*Primary Examiner*—Edward K. Look
*Assistant Examiner*—John Ryznic
*Attorney, Agent, or Firm*—Beveridge, DeGrandi, Weilacher

[57] ABSTRACT

A sheet handling apparatus is provided adjacent to an image forming apparatus. The sheet handling apparatus staples sheets discharged from the image forming apparatus, and it includes a plurality of bins, a stapler, a discharge mechanism, and a stack tray. The sheets are stapled while they are nipped by the discharge mechanism. The bins store the sheets supplied from the image forming apparatus. The stapler staples the sheets stored in the bins. The discharge mechanism discharges the stapled sheets from the bins frontward with respect to the image forming apparatus, where an operator normally stands. The sheet storer is conveyable in both a vertical and a lateral direction. The stack tray is located alongside the front of the image forming apparatus, and stores the sheets discharged by the discharge mechanism.

14 Claims, 15 Drawing Sheets

SHEET HANDLING APPARATUS, WITH SHEET STORAGE BINS CONVEYABLE IN A VERTICLE AND A LATERAL DIRECTION

BACKGROUND OF THE INVENTION

The present invention relates generally to sheet handling apparatus, and more particularly it relates to a sheet handling apparatus which carries out a stapling process or other processes upon sheets discharged from an image forming apparatus or the like.

Some image forming apparatus of conventional types such as copying machines are provided with a sorter for sorting and storing sheets discharged after an image forming process. Some conventional sorters include a stapler for stapling sorted stacks of sheets.

Japanese Patent Laying-Open Nos. 231757/1989 and 231545/1990 disclose such conventional sorters. These sorters are provided with a plurality of vertically arranged bins for receiving and sorting sheets discharged from a copying machine body. In one type of sorter disclosed therein which has vertically conveyable bins, a stapler is provided at a prescribed position in order to staple stacks of sheets in the bins moved into the stapler. In another type of sorter having bins fixed at predetermined positions, a stapler moves vertically in order to staple the stacks of sheets in the bins.

In the sorters disclosed in these prior art documents, stapled stacks of sheets are received into the bins in a one-to-one correspondence, and it is not possible automatically to sort and staple a number of stacks of sheets greater than the number of bins. Accordingly, in order to process more copies than the number of bins, temporarily an operator must take out all the stapled stacks of sheets from the bins after one sequential process, and restart the same operation. Therefore, considerable time must be expended if a large number of copies is to be processed.

Japanese Patent Laying-Open No. 165270/1988 discloses an example of a sorter capable of sorting and stapling a number of stacks of sheets greater than the number of bins provided in the sorter. This sorter has a storing part for stapling and storing stacks of sheets separately from the sheet-sorting bins. Sorted or stapled stacks of sheets are discharged into the storing part.

In this sorter, however, the sheets of a stack tend to become disarranged while being transported from the sorting part to the storing part, making it difficult to achieve optimally arranged sheets for stapling in the storing part.

The storing part of this sorter is disposed under the bins, and the stapled stacks of sheets must be removed from a low position inconvenient for an operator. In addition, it is not possible to staple a stack of sheets at any given position along its edge.

SUMMARY OF THE INVENTION

An object of the present invention is to improve the ease and efficiency of removal of processed sheets from a sheet handling apparatus by an operator.

Another object of the present invention is to enable a sheet handling apparatus to staple optimally arranged stacks of sheets.

Still another object of the present invention is to enable a sheet handling apparatus to select any given stapling position along a stack of sheets.

(1) A sheet handling apparatus according to one aspect of the invention is an apparatus provided adjacent to an image forming apparatus for the processing of sheets discharged from the main body of the image forming apparatus, and it includes bins, a processing unit, a discharge mechanism, and a stocker (also known as a stacker).

The bins store sheets supplied from the image forming apparatus. The processing unit carries out a predetermined process upon the sheets stored in the bins. The discharge mechanism discharges the processed sheets from the bins into the stocker, which is provided on the front side of the apparatus. The stocker stores the sheets discharged by the discharge mechanism.

In this apparatus, the sheets discharged from the image forming apparatus are stored into the bins. The sheets stored in the bins are subjected by the processing unit to a predetermined process, such as a stapling operation. The processed sheets are discharged by the discharge mechanism and stored into the stocker located along the front of the image forming apparatus, where an operator normally stands.

Thus, the processed sheets are discharged to the front side of the apparatus (i.e., the operator side), and accordingly, an operator can remove the sheets smoothly in comparison to the situation of conventional types wherein the sheets are discharged below the bins. In addition, the sheets are discharged into the stocker only after undergoing the predetermined process. Thus a succession of the processes may be carried out consecutively, without any interruption owing to the limited number of bins, and the sheets discharged to the stocker will have been optimally arranged.

(2) A sheet handling apparatus according to another aspect includes bins, a discharge path, a stapler, and a stocker.

The bins store supplied sheets. The discharge path is used to discharge the stacks of sheets stored in the bins. The stapler is disposed in the discharge path to staple stacks of sheets. The stocker stores the stacks of sheets stapled by the stapler.

In this apparatus, the stacks of sheets stored in the bins are discharged into the stocker through the discharge path. The stapler is disposed in the discharge path, and the stacks of sheets are stapled while being discharged.

Consequently, any desired number of stapling processes can be carried out consecutively in cycles. Since the stacks of sheets are stapled while being discharged, it is not necessary to move the stapler, and the sheets may be stapled at arbitrary positions along each stack.

(3) A sheet handling apparatus according to still another aspect includes bins, a processing unit, a discharge unit, and a stocker.

The bins are vertically conveyable and store sheets supplied thereto. The processing unit carries out a predetermined process upon stacks of sheets stored in the bins. The discharge unit discharges the stacks of sheets processed by the processing unit. The stocker stores the stacks of sheets discharged from the discharge unit. The stocker is disposed so that a stack drop position in the stocker is within the range of the vertical movement of the bins.

In this apparatus, sheets are stored in the vertically conveyable bins. The sheets stored in the bins are subjected to the predetermined process, and the processed sheets are discharged to the stocker. Since the stack drop position of the stocker is within the range of the vertical movement of the bins, it is at a relatively high level, allowing the stacks of sheets to be taken out with ease. The stacks of sheets are not discharged into the stocker until they have undergone the predetermined process, ensuring that the process will be carried out upon sheets in a properly arranged state. In addition, the given process can be carried out in a consecutive manner not limited by the number of bins.

(4) A sheet handling apparatus according to a further aspect of the invention includes bins, a stapler, and a moving unit.

The bins which store sheets supplied thereto are movable in the width direction perpendicular to the sheet supplying direction. The stapler staples the stack of sheets stored in each bin. The moving unit moves each bin in the width direction such that the stack of sheets in the bin is located into the stapling position.

The sheets in each bin may be stapled at an arbitrary position along the stack without moving the stapler. Since each bin moves in the width direction, the stack of sheets stored therein can be readily discharged along the width direction, and the stocker for storing processed stacks of sheets may be disposed along the front of the apparatus, where an operator normally stands. Thus, the operator can take out the stacks of sheets smoothly.

(5) A sheet handling apparatus according to a further aspect includes bins, a processing unit, a discharge unit and a stocker.

The bins store sheets supplied thereto. The processing unit carries out a predetermined process upon the stacks of sheets stored in the bins. The discharge unit discharges the processed stacks of sheets from the bins. The stocker is vertically movable and stores the stacks of sheets discharged by the discharge unit.

In the apparatus, the stacks of sheets stored in the bins are subjected to the predetermined process, and the processed stacks of sheets are discharged into the stocker. The stocker is moved vertically in response to the quantity of stacks of sheets discharged into the stocker. Thus, if there is a small quantity of processed stacks of sheets, the stocker remains in a relatively high position, allowing the stacks of sheets to be removed with ease. If there is a large quantity of processed stacks of sheets, the stocker is moved to a lower position in order to increase the capacity of the stocker.

(6) A sheet handling apparatus according to yet another aspect of the invention includes bins, a supplier, a processing unit, a discharger, and a stocker.

The bins store sheets supplied thereto. The supplier supplies the sheets to the bins. The processing unit carries out a predetermined process upon the stacks of sheets stored in the bins. The discharger is disposed in a position different from that of the supplier, and it discharges the processed stacks of sheets from the bins. The stocker stores the stacks of sheets discharged by the discharger.

In this apparatus, the sheets supplied by the supplier are stored into the bins. The stacks of sheets stored in the bins are subjected to the predetermined process, and then they are discharged into the stocker by the discharger.

Since the discharger is disposed separate from the supplier, processed stacks of sheets can be discharged into the stocker by a simple mechanism which is independent of regulation by the components of the supplier.

(7) According to a further aspect of the invention, a sheet handling apparatus includes bins, a discharger, a moving unit, and a stocker.

The bins store sheets supplied thereto. The discharger discharges the sheets from the bins. The moving unit moves each bin such that the sheets therein are located into a nipping position of the discharger. The stocker stores the discharged sheets.

In this apparatus, the supplied sheets are stored in the bins. In order to discharge the sheets in the bins into the stocker, each bin is in turn conveyed toward the discharger. Consequently, it is not necessary to provide a device which withdraws the sheets from the bins and transports them to the discharger.

(8) A sheet handling apparatus in one further aspect includes bins, a stapler, a discharger, and a control unit.

The bins store sheets supplied thereto. The stapler staples the stacks of sheets stored in each bin. The discharger discharges the stack of sheets from each bin while nipping the stack. The control unit controls the discharging of the stack of sheets nipped by the discharger and the stapling process of the stapler therein.

In this apparatus, the stack of sheets in each bin is nipped by the discharger and is stapled in this state. The stapling process is thus reliably executed.

The foregoing and other objects and advantages of the present invention will be more fully apparent from the following detailed description.

DESCRIPTION OF THE PREFERRED EMBODIMENT

General Construction

Figure 1:
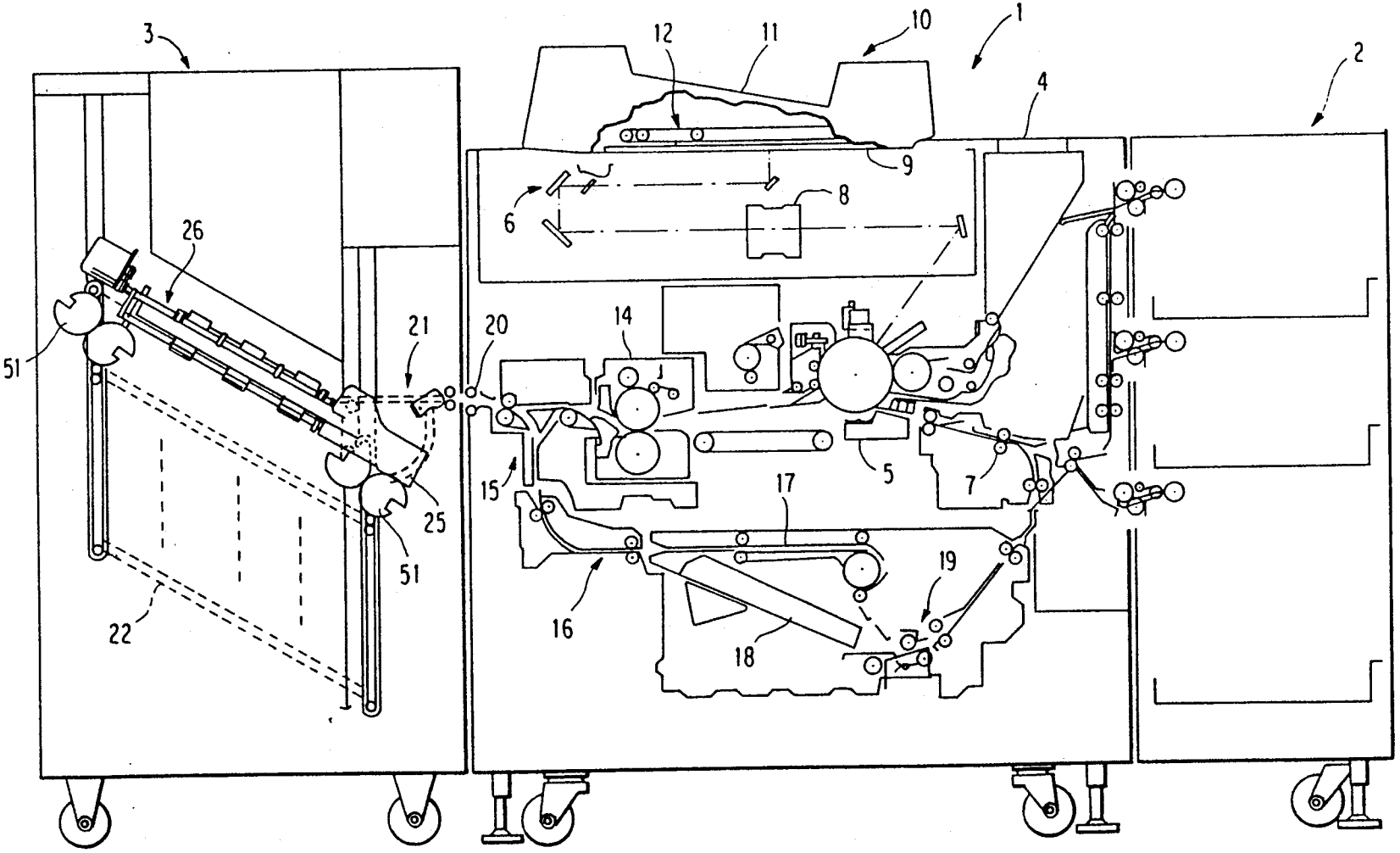
FIG. 1 is a schematic sectional view of a copying machine to which a sorter according to an embodiment of the present invention is applied.

FIG. 1 shows a copying machine outfitted with a stapler-equipped sorter according to an embodiment of the present invention.

Referring to FIG. 1, the copying machine includes a machine body 1, a feed unit 2 fixed on the right side of the machine body 1, and a sorter 3 equipped with a stapler 25 disposed on the left side of the body 1.

Copying Machine Body

The copying machine body 1 includes a case 4, an image forming unit 5 disposed in a central portion of the case 4, an original scanner 6 disposed above the image forming unit 5, and a sheet transport path 7 for supplying and discharging sheets to and from the image forming unit 5.

The image forming unit 5 includes a photoconductive drum disposed at the center, and a charger, a developing unit, a transfer unit, a sheet separator, and a cleaning unit surrounding the photoconductive drum.

The original scanner 6 includes an optical exposure system 8 disposed above the image forming unit 5, an original retainer 9 disposed over the optical exposure system 8, and an automatic original feeder 10 provided on the original retainer 9. In the upper portion of the case of the automatic original feeder 10 is an original receptacle 11, and an original transporting system 12 which has an original conveyance belt disposed inside the case, whereby originals are circulated between the upper surface of the original retainer 9 and the original receptacle 11.

The sheet transport path 7 includes a sheet supply path extending from the feed unit 2 to the image forming unit 5, and a sheet discharge path extending from the image forming unit 5 to an outlet. A fixing unit 14 is provided in the sheet discharging path. To the left of the fixing unit 14 in FIG. 1, there are provided discharge rollers 20 for discharging sheets to the sorter 3, and a reversing device 15 for reversing sheets.

A lower portion of the case 4 includes a lower transport path 16 for transporting sheets from the reversing device 15, a turning unit 17 for turning round the sheets transported through the lower transport path 16, a temporary storing tray 18 into which sheets are temporarily stored, and a sheet refeeder 19 for transporting the sheets out of the tray 18.

Structure of the Sorter

The structure of the sorter 3 is shown in FIGS. 2 to 13.

Figure 5:
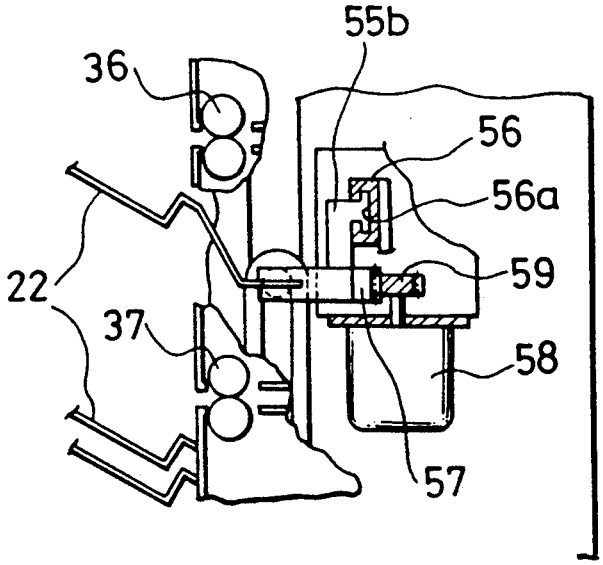
FIG. 5 is a partly in section front view of a bin conveying mechanism of the sorter.
Figure 6:
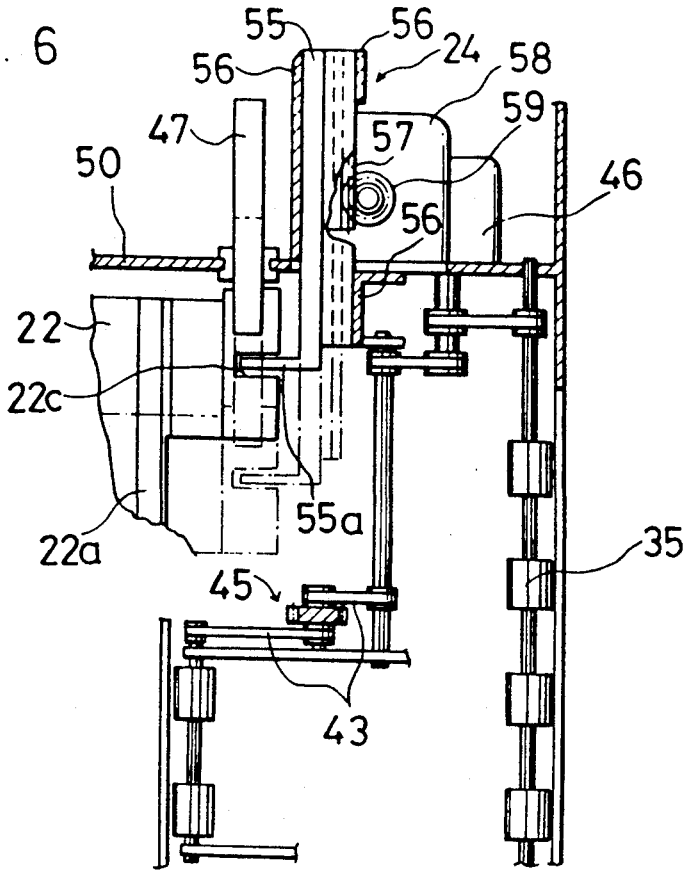
FIG. 6 is a partial plan view of a mechanism for horizontal conveyance of a bin in the sorter.
Figure 7:
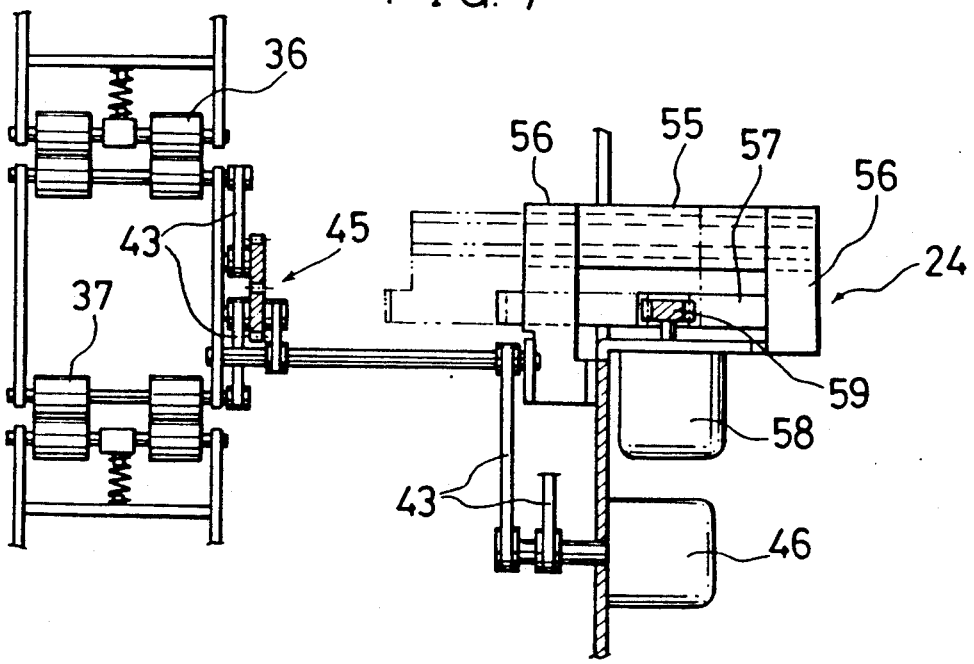
FIG. 7 is a partly in section view thereof.

The sorter 3 includes a supply mechanism 21 for supplying sheets discharged from the copying machine body 1 to the sorter 3, a plurality of bins 22, a mechanism 23 for vertically conveying the bins 22, and a mechanism 24 for horizontally conveying each bin 22 in the width direction (shown in FIGS. 5 to 7). The sorter 3 further includes a stapler 25 for stapling sheets in the bins 22, a discharge roller mechanism 26 for discharging the stapled sheets to a front portion of the sorter 3 (i.e., toward the operator side), a drive mechanism 27 for driving the discharge roller mechanism 26, a stock (or "stack") tray 28, and a mechanism 29 for vertically moving the stock tray 28. A lateral guide bar 30 which abuts on a common side of the sheets in the bins 22, and a lateral guide drive mechanism 31 are disposed in a rear portion of the sorter 3 (opposite the operator side).

Sheet Supply Mechanism

Figure 2:
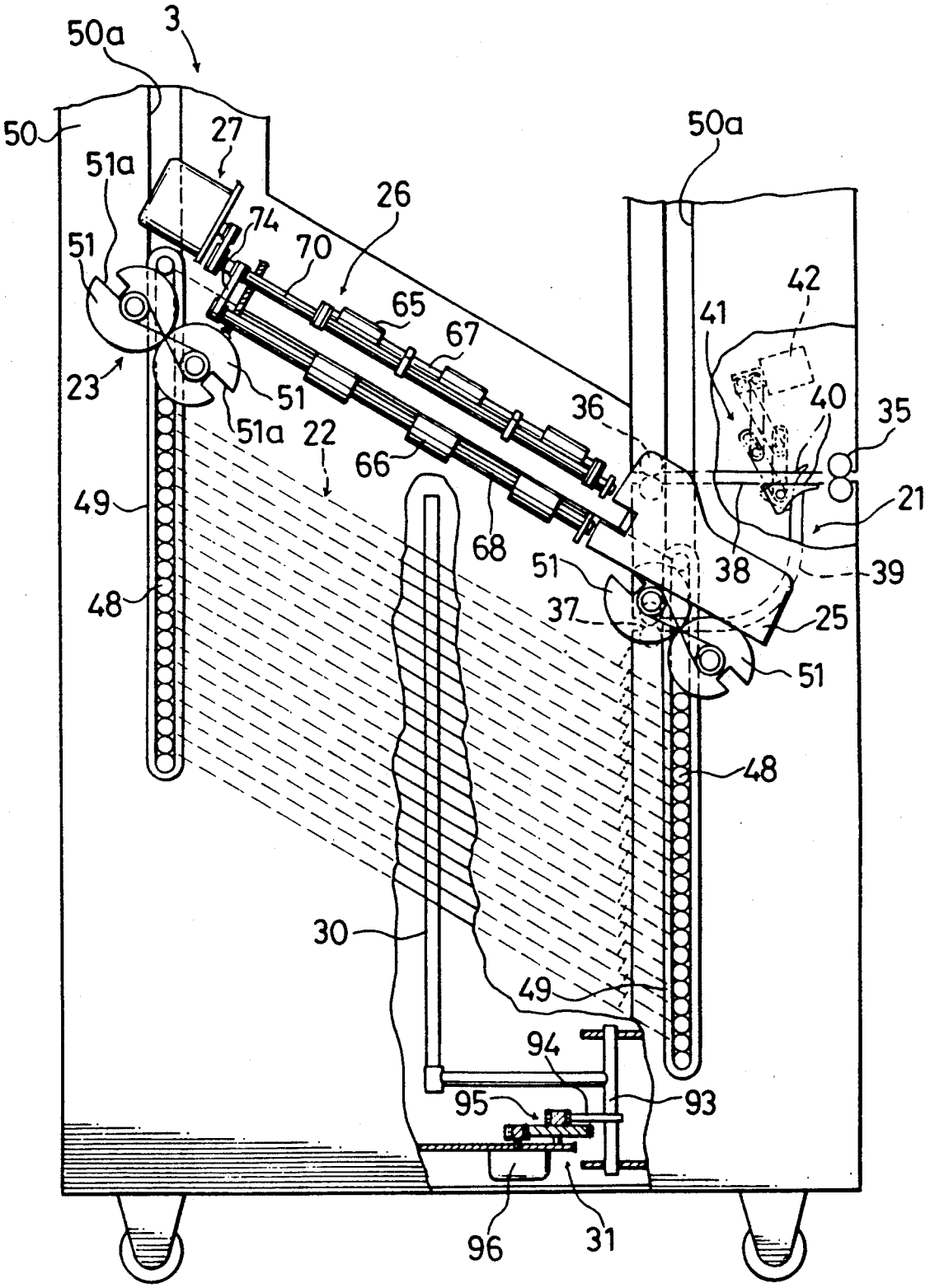
FIG. 2 is a cutaway front view of the sorter.
Figure 3:
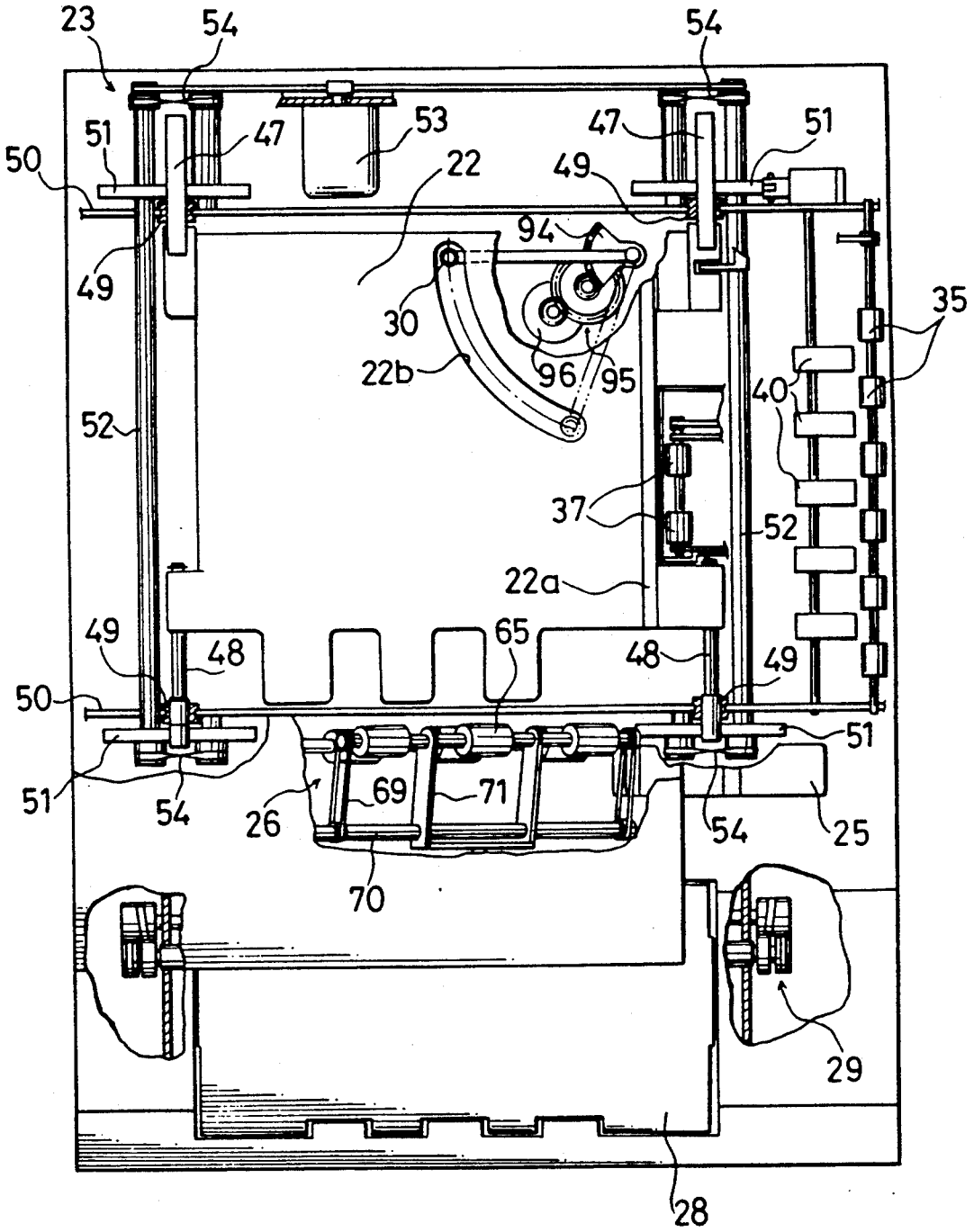
FIG. 3 is a cutaway plan view of the sorter.
Figure 4:
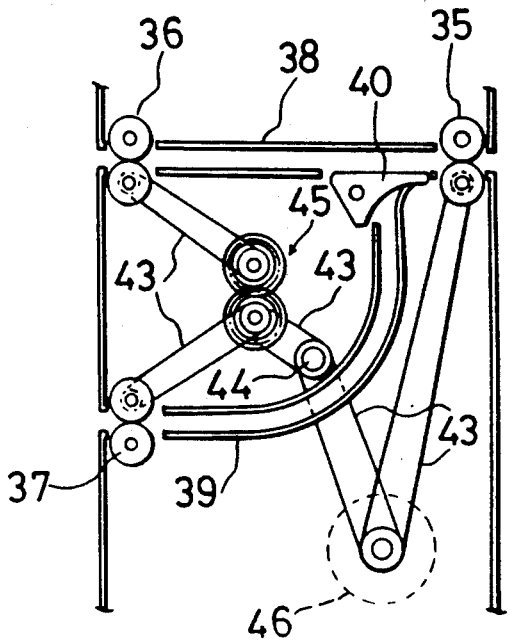
FIG. 4 is a schematic sectional view of a supply mechanism of the sorter.

The sheet supply mechanism 21 is disposed between the copying machine body 1 and the plurality of bins 22. As shown in FIGS. 2, 3 and 4, the mechanism 21 includes first guide rollers 35 disposed at the end closest to the body 1, second guide rollers 36 disposed at the opposite end, and third guide rollers 37 disposed below the second guide rollers 36. A non-sorting mode transport path 38 is provided between the first guide rollers 35 and the second guide rollers 36. A sorting mode transport path 39 branches from the transport path 38 and guides sheets to the third guide rollers 37. A claw member 40 for switching the route of transport is provided at a junction of the transport paths 38 and 39. The claw member 40 is coupled to a solenoid 42 through a linkage 41. The claw member 40 is movable between a sorting position, shown by chained lines in FIG. 2, and a non-sorting position, shown by solid lines, through the operation of the solenoid 42. The guide rollers 35, 36 and 37 are coupled to a drive motor 46 by means of belts 43, pulleys 44, and gear trains 45 as shown in FIGS. 4 and 7.

Bins

The plurality of bins 22 are sloped so that the ends onto which the leading edges of sheets are received (i.e., the left ends in FIG. 1), are higher than the opposite ends of the bins 22 (i.e., the right ends), onto which the trailing edges of sheets arrive. Each bin 22 is substantially rectangular in form, as shown in FIG. 3. The bins 22 can be conveyed both vertically and widthwise, in the direction perpendicular to the sheet supplying direction. Either end of each bin 22 is provided with trunnions 47 and 48 projecting outward in the width direction. The trunnions 47 form pairs toward the rear of the apparatus are fixed to each bin 22. The pairs of trunnions 48 toward the front are slidable with respect to each bin 22. The trunnions 47 and 48 are supported by trunnion support frames 49 in a vertically movable manner. Each trunnion support frame 49 has an elongate form extending vertically and is provided with a guide slot into which respective trunnions 47 or 48 are inserted. Each trunnion support frame 49 moves vertically along a guide groove **50*a* extending vertically in a frame 50 of the sorter 3. The side of each bin 22 toward the front has a saw-tooth form as shown in FIG. 3 so as not to interfere with the discharge roller mechanism 26 when the bin 22 is conveyed frontward. The right end of each bin 22 is provided with a stop 22*a* for properly adjusting the sheet edges therein. An arcuate lateral guide slot 22*b* is formed in each bin 22 in a rear portion opposite the operator side. The lateral guide bar 30 is inserted through the slots 22*b***.

Vertical Conveyance Mechanism

The mechanism 23 for vertically conveying the bins 22 includes four pairs of cams 51 disposed corresponding to the portions of the trunnions 47 and 48, coupling rods 52 along either end of the bins 22 for coupling pairs of the cams 51, and a cam drive motor 53 for driving the coupling rods 52. Each pair of cams 51 is coupled by a crossed belt 54 and rotates in reciprocal opposition. The outer surface of each cam 51 is a corresponding portion of an Archimedes spiral and has a radial slot **51*a* engageable with respective trunnions 47 or 48**.

Horizontal Conveyance Mechanism

The mechanism 24 for horizontally conveying each bin 22 in the width direction will be described.

As shown in FIGS. 5, 6 and 7, a sliding member 55 is provided in the region to the rear of the right ends of the bins 22. A sliding guide projection **55*b* constitutes the upper portion of the sliding member 55. A support member 56 for supporting the sliding member 55 is fixed to the frame 50 of the sorter 3. The support member 56 has a groove 56*a* extending in the width direction, and the sliding guide projection 55*b* is slidably interlocked into the groove 56*a*. A rack 57 is formed in a portion of the base of the sliding member 55 nearer the machine body 1. A pinion 59 fixed to the shaft of a horizontal conveyance motor 58 is engaged with the rack 57. A projection 55*a* projecting toward the bin 22 is formed at the end of the sliding member 55 nearer the front of the apparatus. The projection 55*a* engages a groove 22*c*** formed in the right end of each bin 22. The bin 22 is thus conveyed in the width direction by means of the sliding member 55 when the motor 58 rotates.

Stapler

The stapler 25 is disposed in a position nearer the front of the apparatus, at a level corresponding to the discharge roller mechanism 26, so as not to create any obstacle to the supplying of sheets, as shown in FIGS. 2 and 3.

Discharge Roller Mechanism

Figure 8:
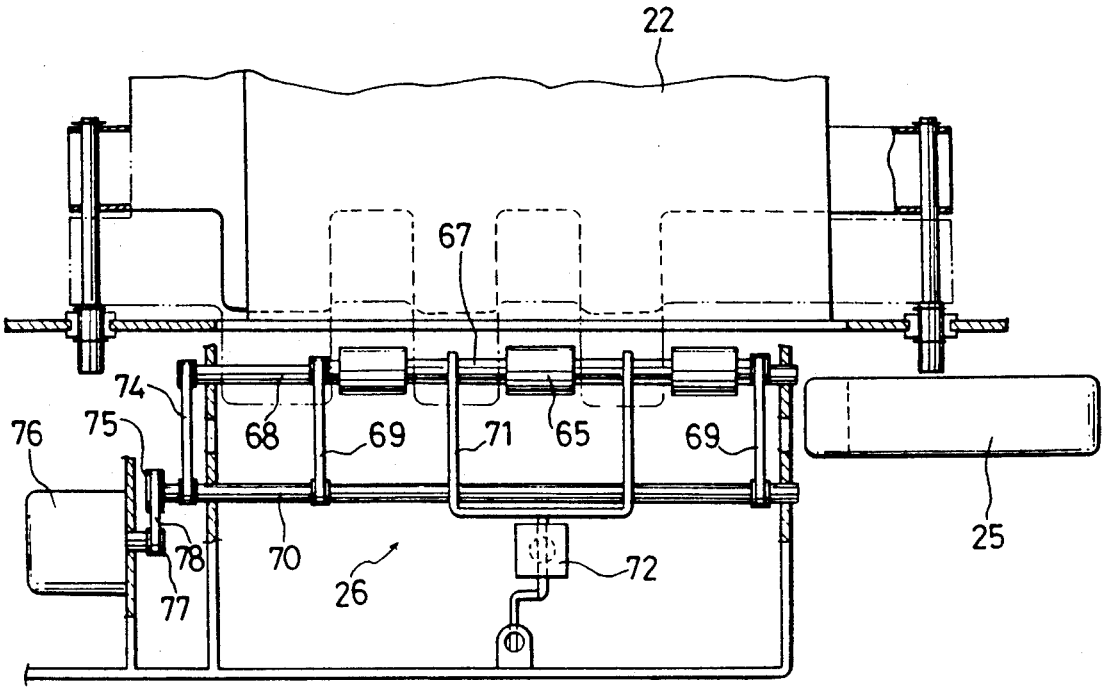
FIG. 8 is a plan view of a discharge mechanism of the sorter.
Figure 9:
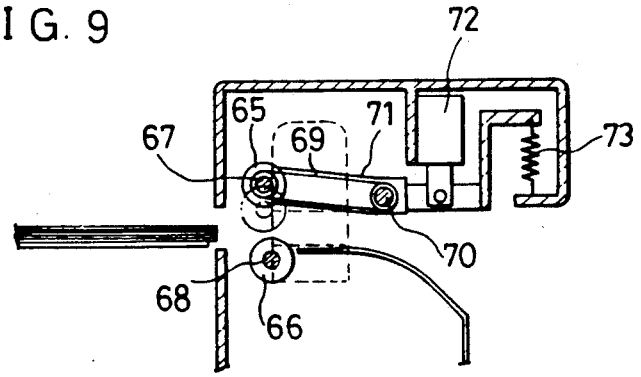
FIG. 9 is a schematic sectional view of the discharge mechanism.

The discharge roller mechanism 26 includes three upper discharge rollers 65 which are vertically movable, and three lower discharge rollers 66 which are located in fixed positions. The upper and lower discharge rollers 65 and 66 are fixed onto roller shafts 67 and 68, respectively. The upper roller shaft 67 rotates together with a drive shaft 70 by means of two belts 69 as shown in FIGS. 8 and 9. The drive shaft 70 is supported rotatably by the frame 50 of the sorter 3. As shown in FIGS. 3 and 8, a U-shaped support member 71 is rotatably fitted near its base onto a central portion of the drive shaft 70. The upper roller shaft 67 is rotatably supported through the tips of the U-shaped support member 71. A solenoid 72 for vertically moving the upper discharge rollers 65 is provided in a tab on the base of the member 71, as shown in FIGS. 8 and 9. If stacks of sheets are neither to be stapled nor discharged, the solenoid 72 will be off, and the upper discharge rollers 65 remain raised by a spring 73 provided to an end portion of the base tab on the U-shaped member 71.

The lower roller shaft 68 is supported rotatably by the frame of the sorter 3, and a belt 74 extends around the lower roller shaft 68 and the drive shaft 70 of the upper discharge roller 65. A pulley 75 is fixed to one end of the drive shaft 70, and it is coupled to a pulley 77 above at the end of a discharge roller motor 76 by means of a belt 78.

Stocker

Figure 10:
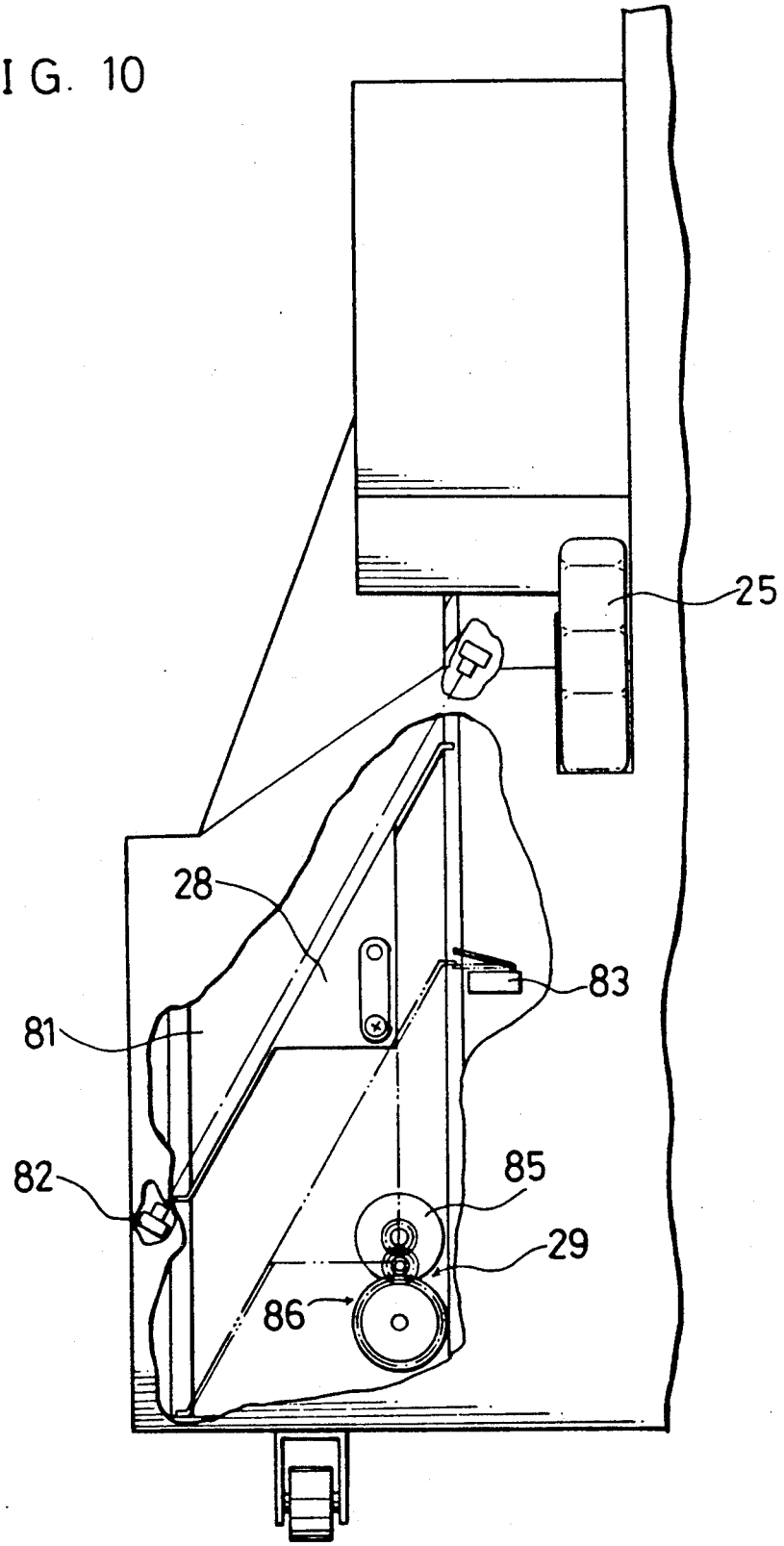
FIG. 10 is a cutaway side view of a stocker of the sorter.
Figure 11:
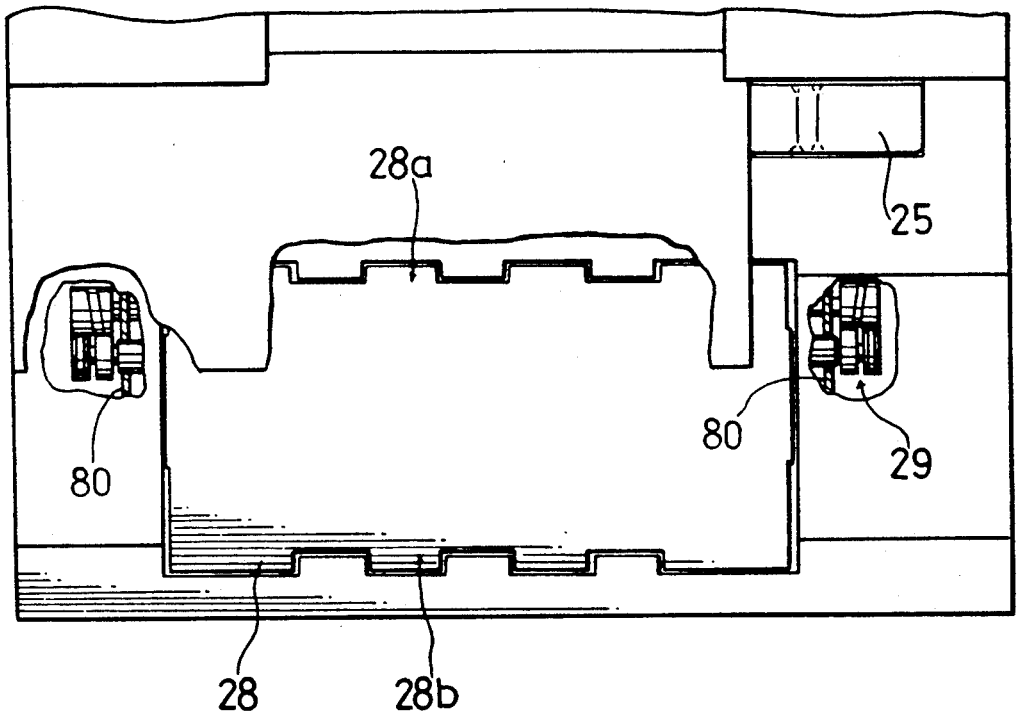
FIG. 11 is a cutaway plan view of the stocker.

As shown in FIGS. 10 and 11, a stocker 81 for storing stacks of sheets includes a stock tray 28 and a sub frame 80. The stocker 81 is provided on the front side of the sorter 3, i.e., the operator side. FIG. 10 is a right side cutaway view of the sorter 3, and FIG. 11 is a cutaway plan view thereof. The stock tray 28 is vertically movable along the sub frame 80 provided in the front of the sorter 3. The stock tray 28 is sloped such that the end nearer the front is located lower than the opposite end thereof. A pair of sheet sensors 82 are provided above and below the stock tray 28. Each of the sheet sensors 82 comprises a photo-interrupter. When an excess of sheet stacks accumulates on the stock tray 28, causing an interruption between the sheet sensors 82, the stock tray 28 is lowered by a predetermined amount. A limit switch 83 is provided at the lowest position of one end of the stock tray 28. When the stock tray 28 lowers and contacts the limit switch 83, a signal is provided to an operation panel to indicate that the stocker 81 is full.

Figure 12:
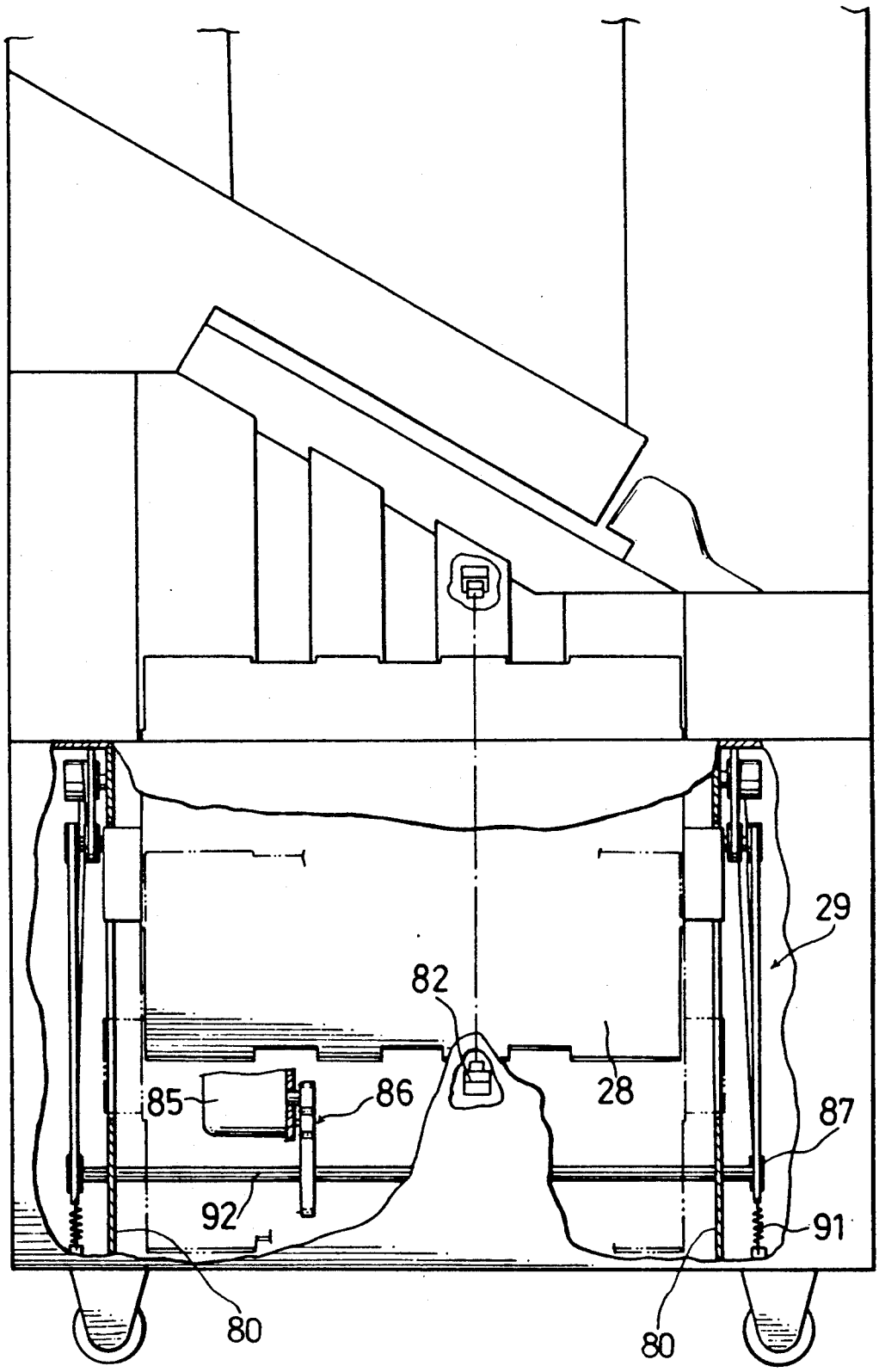
FIG. 12 is a cutaway front view of the stocker.
Figure 13:
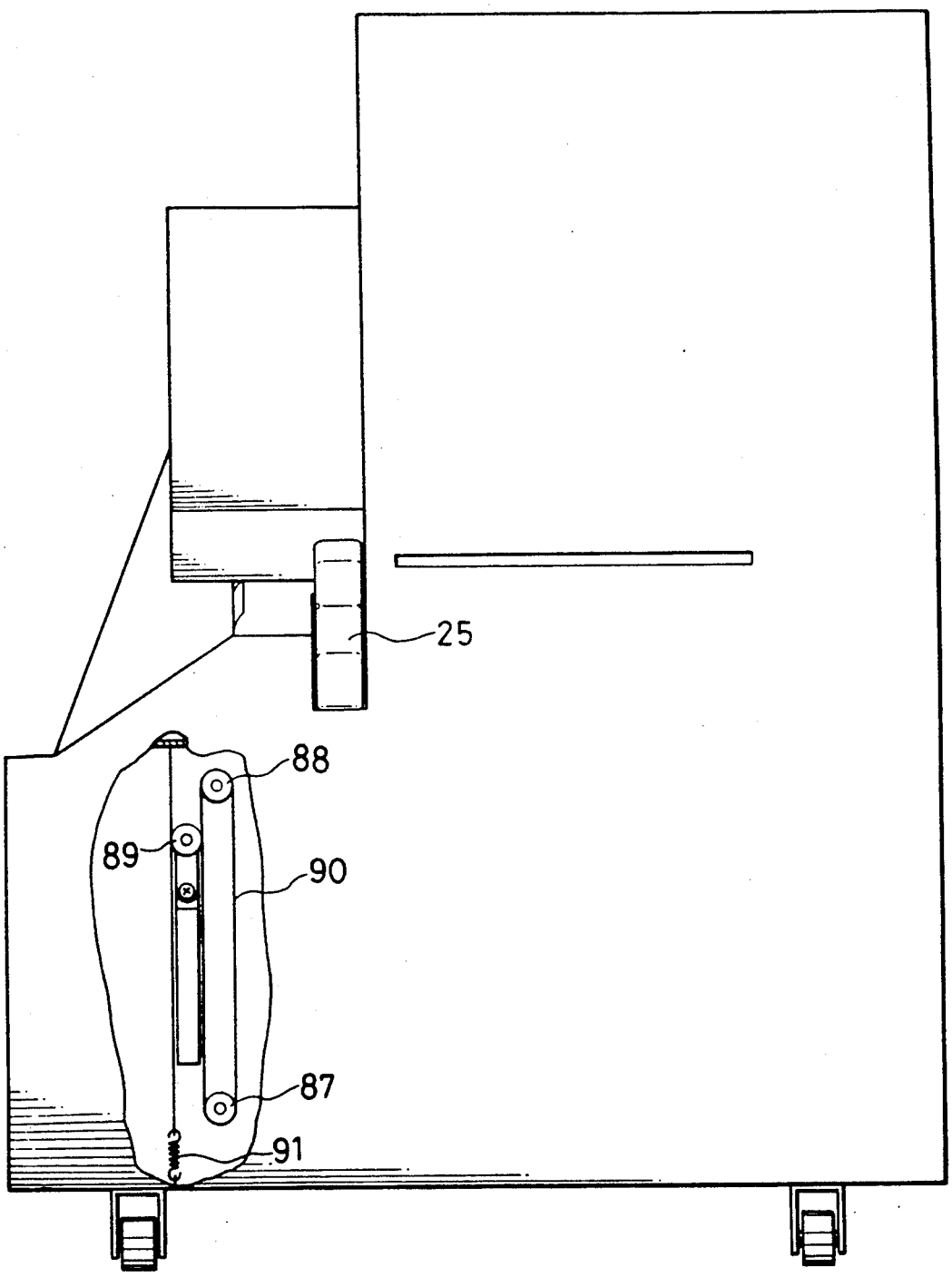
FIG. 13 is a cutaway side view of a moving mechanism of the stocker.

The stock tray 28 is moved vertically by tray drive mechanisms 29 provided on either side thereof. Both tray drive mechanisms 29 incorporate a tray drive motor 85, a gear train 86, drive pulleys 87 and fixed pulleys 88 as shown in FIGS. 12 and 13, pulleys 89 fixed to the stock tray 28, and belts 90 extending around these pulleys. One end of the belt 90 is attached to the frame 50 of the sorter 3 by means of a spring 91. A drive shaft 92 is provided which couples the drive pulleys 87 to the gear train 86.

As shown in FIG. 11, the upper end 28*a* and the lower end 28*b* of the stock tray 28 are comb-like in order to prevent sheets from falling through gaps between the stock tray 28 and the frame Lateral Guide Mechanism As shown in FIG. 2, the lateral guide bar 30 is L-shaped. A rotating rod 93 extending vertically is fixed onto the end of the base of the lateral guide bar 30. The rotating rod 93 is supported rotatably by the frame 50 of the sorter 3. A sectoral gear lever 94 is fixed to the rotating rod 93, as shown in FIGS. 2 and 3. The gear lever 94 is coupled to a lateral guide bar drive motor 96 by means of a gear train 95.

Control Block

Figure 14:
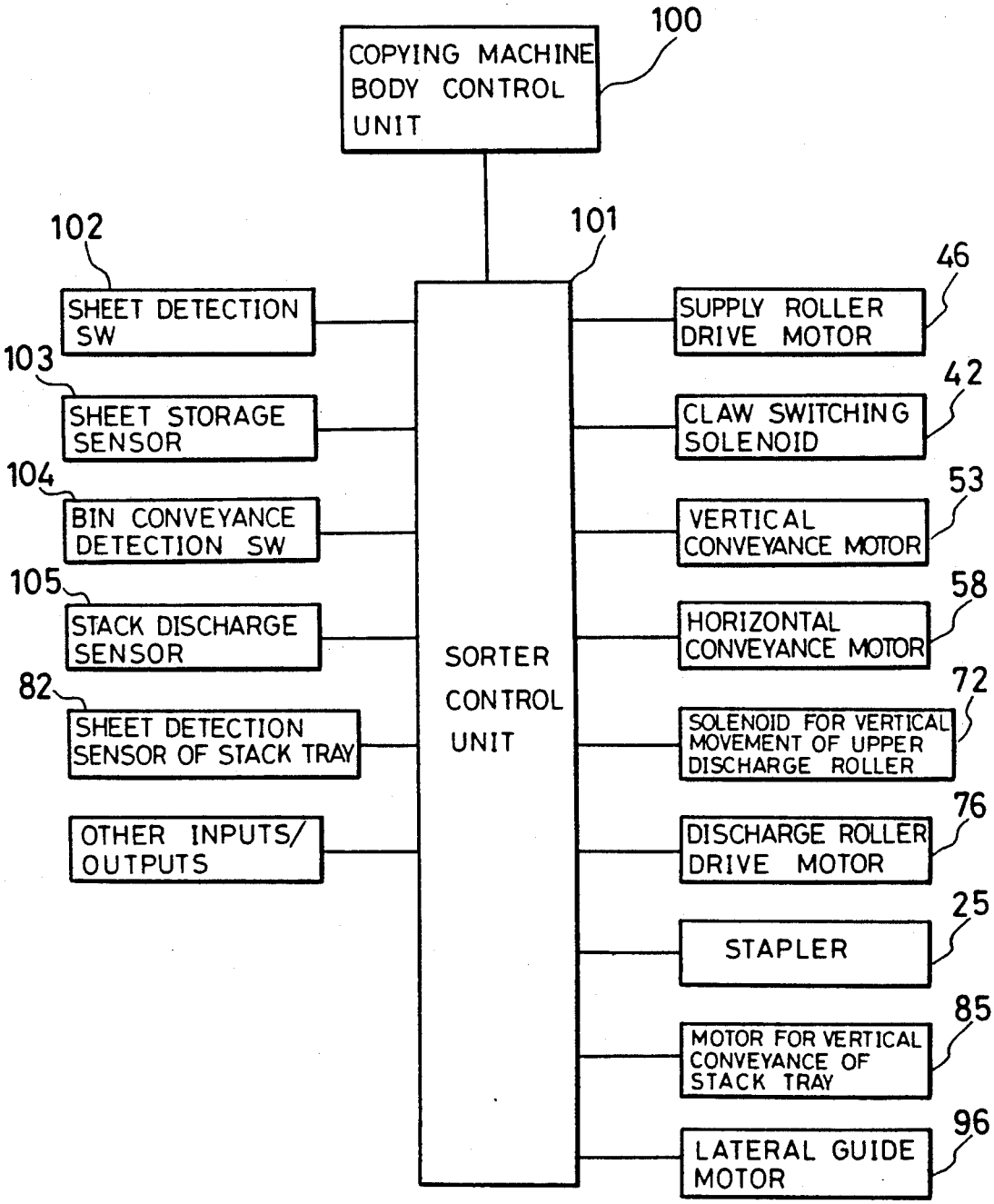
FIG. 14 is a block diagram of the sorter control.

As shown in FIG. 14, the copying machine body 1 and the sorter 3 have control units 100 and 101, respectively, which include a microcomputer consisting of a CPU, RAM, ROM, etc. The machine body control unit 100 and the sorter control unit 101 in connecting with each other. The machine body control unit 100 is connected with an operation panel, sensors, an image formation drive unit and other components, not shown. The sorter control unit 101 is connected with a sheet detection switch 102 for detecting the transport of a sheet to the sorter 3, a sheet storage sensor 103 for detecting the storage of sheets into the bins 22, a bin conveyance detection switch 104 for detecting the conveyance of a bin 22 into a predetermined position in the sheet discharging direction, a stack discharge sensor 105 for detecting the discharge of a stack of sheets from a bin 22 into the stocker 81, the pair of sensors 82 for detecting the sheet stack level in the stock tray 28, and other inputs and outputs. The sorter control unit 101 is further connected with the drive motors in the sorter 3, solenoids, and the stapler 25.

Sheet Supply Operation

The sheet supply operation is described herein.

When a sheet is discharged from the copying machine body 1, the guide roller drive motor 46 rotates, whereby the first to third guide rollers 35 to 37 rotate by means of the belts 43, the pulleys and related elements. If the non-sorting mode is selected as the operation mode, the solenoid 42 will be off and the claw member 40 will be positioned as shown by the solid lines in FIG. 2 by the agency of a spring, not shown, and the link mechanism 41. In this case, sheets will be supplied to the non-sorting bin by means of the first guide rollers 35, the non-sorted sheet transport path 38 and the second guide rollers 36. If the sorting mode is selected as the operation mode, the solenoid 42 will be on and the claw member 40 will be positioned as indicated by the chained lines in FIG. 2 by means of the link mechanism 41. In this case, sheets discharged from the copying machine body 1 are supplied to the bins 22 by means of the first guide rollers 35, the sorted sheet transport path 39 and the third guide rollers 37.

Vertical Conveyance of Bins

If the sorting mode is selected, the bins 22 are vertically conveyed so that sheets supplied through the sheet supply mechanism 21 are sorted and stored into the bins 22. In this case, the motor 53 operates to rotate the cam shafts 52, whereby the pairs of cams 51 rotate. The rotation of the cams 51 transports the trunnions 47 and 48 of the bins 22 upward or downward as they are successively engaged by the slots 51*a* of the cams 51. Consequently, the bins 22 are conveyed upward or downward, whereby the support frames 49 supporting the trunnions 47 and 48 are meanwhile moved upward or downward along the grooves 50*a*. Supplied sheets are thus sorted and stored in the bins 22.

Lateral Guide Operation

Each time a sheet is stored in the respective bin 22, the rear edge of the sheet is brought into properly adjustment. Before a sheet is supplied into the bin 22, the lateral guide bar 30 is in the withdrawn position along the sheet supplying direction as shown by the solid lines in FIG. 3. When a sheet has been received into a bin 22, the lateral guide drive motor 96 is driven to rotate the lateral guide bar 30 (counterclockwise in FIG. 3) by means of the gear train 95 and the gear lever 94. The amount of rotation of the lateral guide bar 30 is controlled in dependency on the paper size. By this controlled rotation, the lateral guide bar 30 abuts on the rear edge of the sheet so as to position it properly.

Widthwise Conveyance of a Bin

If the stapling-sorting mode is selected, a stapling process is performed after a sorting process. When the sorting process ends, the bins 22 are temporarily conveyed to the initial position shown in FIGS. 1 and 2. Then, each of the bins 22, now storing stacks of sheets, is conveyed in turn to a level corresponding to the stapler 25. When a bin 22 is positioned at this level, a cutout 22*c* in the bin comes into engagement with the projection 55*a* of the sliding member 55. The motor 58 then rotates, moving the sliding member 55 toward the front of the apparatus in the width direction, as indicated by the chained lines in FIG. 6, by the mesh of the pinion 59 and the rack 57. In consequence, the bin 22 is also conveyed in the width direction toward the front of the apparatus, and the comb-like projections of the front edge of the bin 22 enter a gap between the rollers of the discharge mechanism 26, whereby the bin 22 is in the stapling position.

Stapling and Discharge Operation

During the sorting process, the solenoid 72 of the discharge roller mechanism 26 is off and the upper discharge rollers 65 are held upward by the spring 73.

When a bin 22 has been conveyed into the stapling position as described above, the solenoid 72 is activated, whereby the upper discharge rollers 65 are lowered, nipping the stack of sheets in the bin 22 between the upper and lower discharge rollers 65 and 66. In this state, one corner of the stack of sheets is located into the stapling position of the stapler 2. The stapler 25 is then activated to staple the stack of sheets. In order to staple the stack of sheets at a mid point or at two points along its end, the stack of sheets is transported appropriately by the discharge roller mechanism 26. When the stapling is complete, the discharge roller drive motor 76 is driven to rotate the upper and lower discharge rollers 65 and 66 by means of the pulleys 77 and 75, the belt 78 and the related elements, whereby the stapled stack of sheets is discharged into the stock tray 28.

The stock tray 28 in the initial state is located in its uppermost position, as shown by solid lines in FIG. 10. When the stack of sheets is discharged as explained it is stored into the stocker 81, comprising the stock tray 28 and the sub frame 80. The stacks of sheets in the bins 22 are successively discharged, and when an excess of stacks accumulates in the stock tray 28, the sensors 82 detect the excess, whereupon the stock tray drive mechanism 29 operates to lower the stock tray 28 by a predetermined amount.

According to this embodiment, the stack of sheets is stapled while nipped between the upper and lower rollers 65 and 66, still stored in the bin and consequently properly arranged for reliably stapling. Since the mechanism 26 for discharging the stapled stacks of sheets is located higher than the sheet supply mechanism 21, the supply mechanism 21 does not obstruct their discharge.

Moreover, the discharge of the staled stacks of sheets along the width direction toward the front of the apparatus is smooth, since the stop 22*a* of each bin 22 is not an obstruction. Because the stapled stacks of sheets are discharged to the front of the apparatus, the operator can easily remove them. In addition, since the stock tray 28 is vertically movable, it will be located in a relatively high position if a small quantity of sheets are processed, and accordingly, the operator can readily remove the stapled stacks of sheets. In cases wherein a large quantity of sheets are processed, the stocker 81 provides sufficient capacity for storing the stacks of sheets since the stock tray 28 lowers in accordance with the quantity of stacks.

Since each bin 22 is conveyed in the width direction, the stapler 25 does not need to be moved, and can be fixed in a position so as not to be any obstacle to the supply and discharge of sheets. The stack of sheets to be stapled is nipped between the upper and lower discharge rollers 65 and 66, and the degree of transport of the stack is therein controlled. Consequently, it is possible to set a stapling position at an arbitrary point along a stack of sheets, and it is possible to staple at several points along it as well.

Control

The sorter 3 is controlled by the control unit 101 according to the program shown in FIGS. 15A to 15D.

When a main switch of the sorter 3 is switched on, initialization is performed at step S1. In the initialization, the bins are set to the initial position, and the claw member 40, the upper discharge rollers 65, the lateral guide bar 30, etc. are set to their respective initial positions. At step S2, there is a pause for a start signal from the copying machine body control unit 100. When the start signal is received, the program proceeds from step S2 to step S3. At step S3, it is determined whether or not a plurality of copies is to be handled. If not, the program proceeds to step S4, performing the process of an auxiliary mode, and then the program returns to step S2.

If a plurality of copies are to be handled, the program proceeds from step S3 to step S5. At step S5, it is determined whether or not the stapling-sorting mode is selected. If not, the process of the auxiliary mode at step S4 is performed. If the stapling-sorting mode is selected, the program proceeds to step S6 to designate the preset number of copies as the number of sheets to be sorted for each original. At step S7, it is determined whether the designated number of sheets is 20 or less. The number of bins 22 in this embodiment is 20, and the determination made at step S7 is as to whether the designated number of sheets is equal to or smaller than the number of bins. If the designated number of sheets is larger than 20, the program proceeds to step S8. At step S8, the difference "designated number -20" is stored as "A" in memory. Then, at step S9, the designated number of sheets is set to 20, and the program proceeds to step S10. If the designated number of sheets is 20 or less, the difference "A" is set to "0" at step S38, and the program proceeds to step S10.

At step S10, there is a pause for the discharge of a sheet to the sorter 3. When the sensor 102 detects the discharge of a sheet from the copying machine body 1, the program proceeds to step S11. At step S11, it is determined whether the transported sheet is a copy of an odd-numbered original or not. The determination as to whether this is so depends on information transmitted from the copying machine body control unit 100. If the original is the first one, the determination at step S11 is always "Yes" and the program proceeds to step S12. At step S12, the sheet is supplied to the uppermost (the first) bin 22, and "n" (which is the number of bins receiving copy sheets of an odd-numbered original) is set to "1" at step S14. Then, the program proceeds to step S15. If the original is then replaced by an even-numbered original and a copy thereof is discharged from the copying machine body 1, the program proceeds from step S11 to step S13. At step S13, the sheet is supplied to the "n"th bin, and the program proceeds to step S15. Thus, the sheet is supplied to the lowermost of the bins into which sheets are stored. At step S15, the lateral guide bar 30 rotates to abut against the rear edges of the sheets. Then, at step S16, it is determined whether the designated number of sheets has been sorted or not.

If the designated number of sheets has not been sorted, the program proceeds to step S17 and awaits the discharge of a sheet from the copying machine body 1. If the discharge of a sheet is detected, the program proceeds to step S18 to determine whether or not the sheet is a copy of an odd-numbered original. If so, the sheet is supplied to the "n+1"th bin at step S19, and at step S20, "n" is set to "n+1". Then, the program returns to step S15. Thus, through steps S19 and S20, the sheets are successively supplied to the bins 22 starting from the uppermost if the original is odd-numbered.

If it is determined at step S18 that the sheet is a copy of an even-numbered original, the program proceeds to step S21. At step S21, the sheet is supplied to the "n−1"th bin, and the program proceeds to step S22 to set "n" to "n−1". Then, the program returns to step S15. Thus, by the operations at steps S21 and S22, the sheets are successively supplied to the bins 22 starting from the lowermost of the bins into which sheets are stored.

The above-described operations are repeated and if the designated number of sheets for the corresponding original has been sorted, the program proceeds from step S16 to step S23. At step S23, it is determined whether a copy of a subsequent original exists or not. If so, the program returns to step S10 to repeat the operations at steps S10 to S23 as described above.

If sheets for all the originals have been sorted, the program proceeds from step S23 to step S24. At step S24, the uppermost bin 22 is conveyed to the stapling level. Then, at step S25, the stock tray 28 is moved into its uppermost position. At step S26, the bin 22 is transported toward the front, whereby the stack of sheets in the bin 22 is placed into position for stapling by the stapler 25. Then, the program proceeds to step S27, wherein the stack of sheets is nipped between the upper and lower discharge rollers 65 and 66. At step S28, it is determined whether the stapling position is a desired position. If it is not a desired position, the program proceeds to step S29 to rotate the upper and lower discharge rollers 65 and 66, whereby the stack of sheets is transported into the desired position. If the stack is in the desired position, the program proceeds from step S28 to S30. At step S30, the stapler 25 is driven to staple the stack of sheets.

At step S31, it is determined whether the stack of sheets has been stapled at all desired points or not. If the stack of sheets should be stapled at two points, it is determined whether the stack of sheets has been stapled thus. If there remains a point at which the stack of sheets should be stapled, the program returns to step S28 of FIG. 15C to convey the stack into the desired position, wherein the sheets are stapled.

If the stack of sheets has been stapled at all desired points, the program proceeds from step S31 to step S32. At step S32, the upper and lower discharge rollers 65 and 66 are driven to discharge the stack into the stock tray 28. Then, at step S33, the stock tray 28 is lowered by an amount corresponding to one bin.

At step S34, it is determined whether the designated number of stacks of sheets have been stapled. If they have not been, the program proceeds to step S35. At step S35, the succeeding bin is conveyed to the level corresponding to the stapler 25, and the program returns to step S26 of FIG. 15C in order that the sheets in the bin be stapled.

Figure 15A:
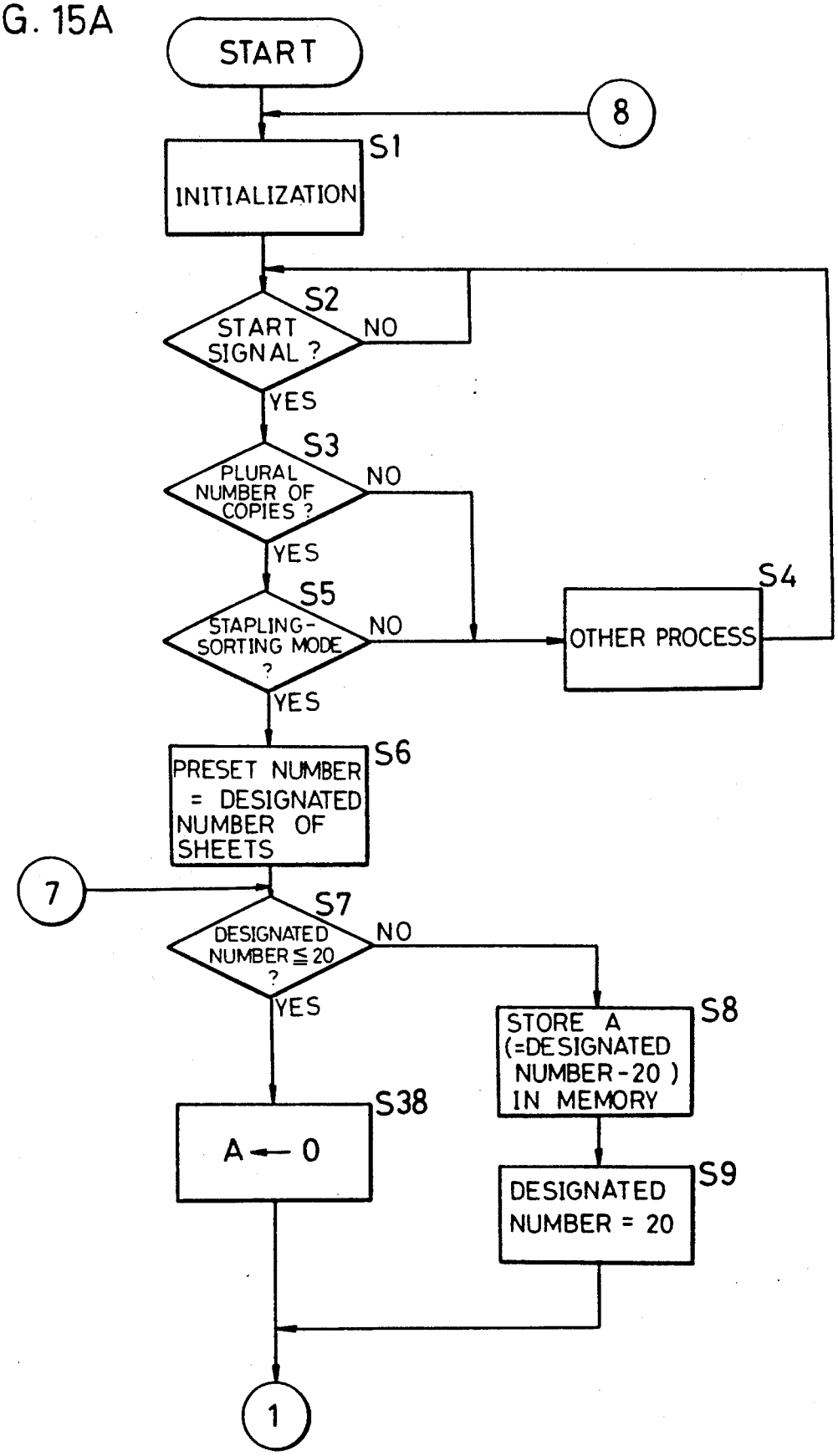
FIGS. 15A to 15D are flow charts of the control program of the sorter.
Figure 15B:
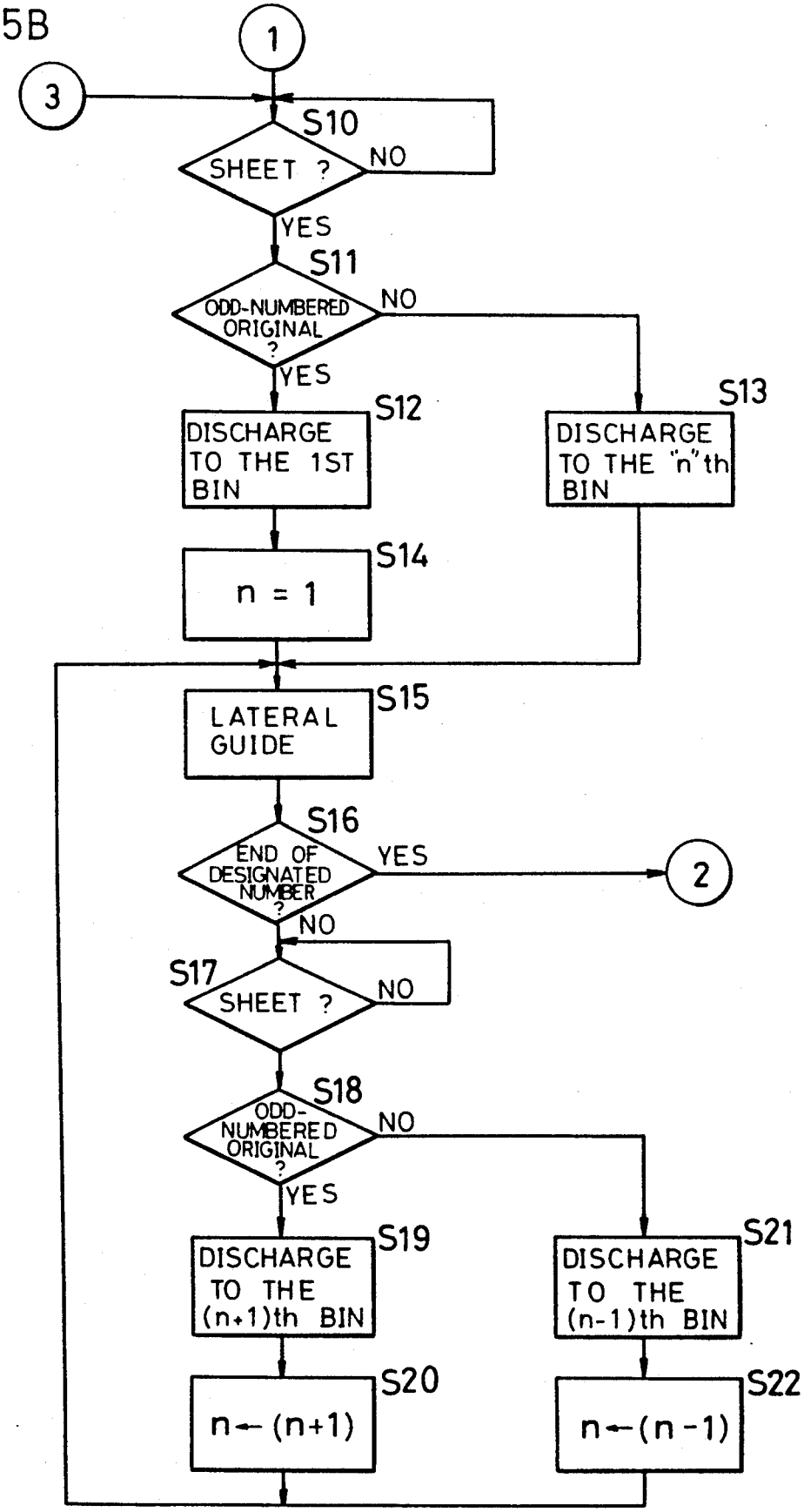
Figure 15C:
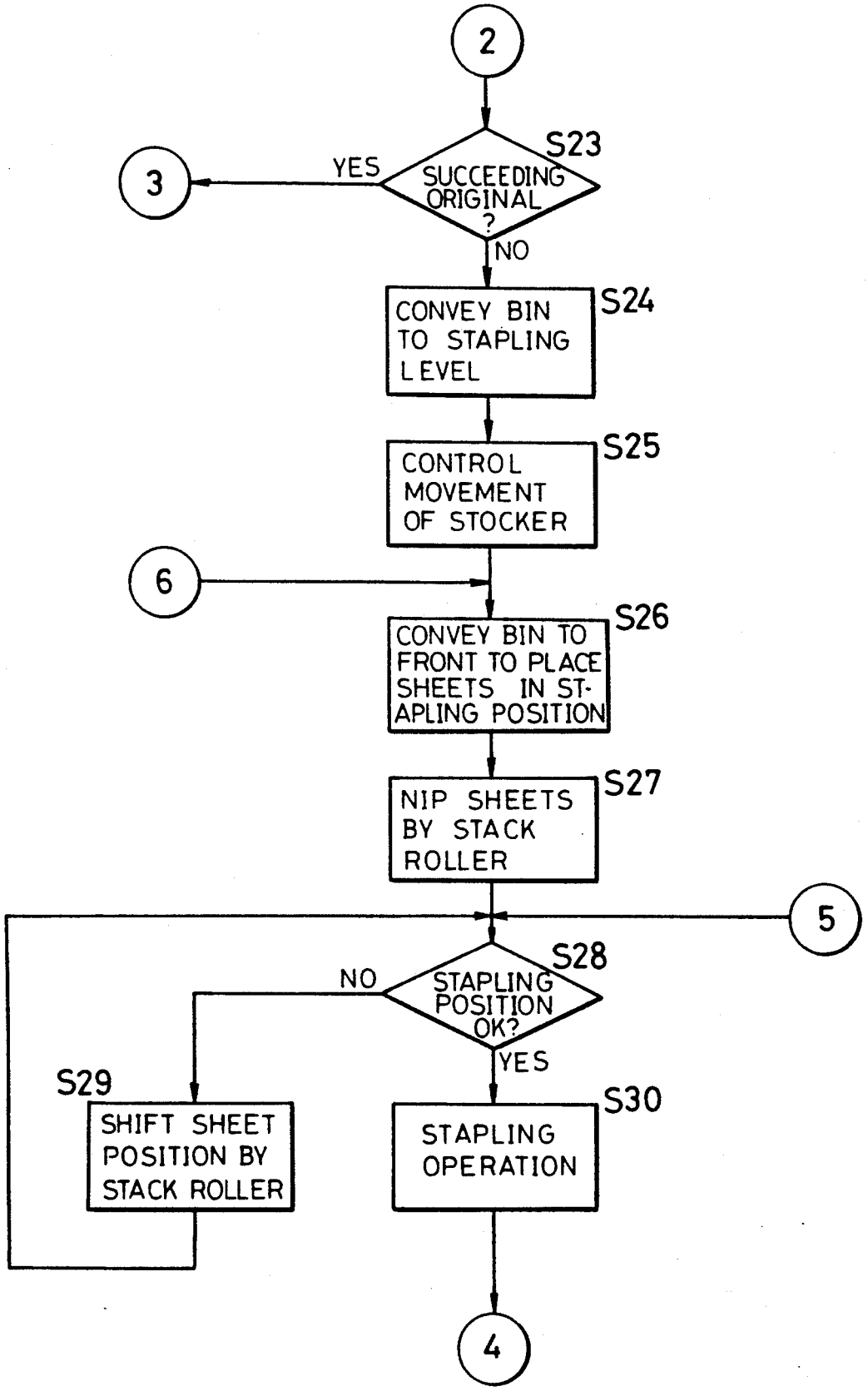
Figure 15D:
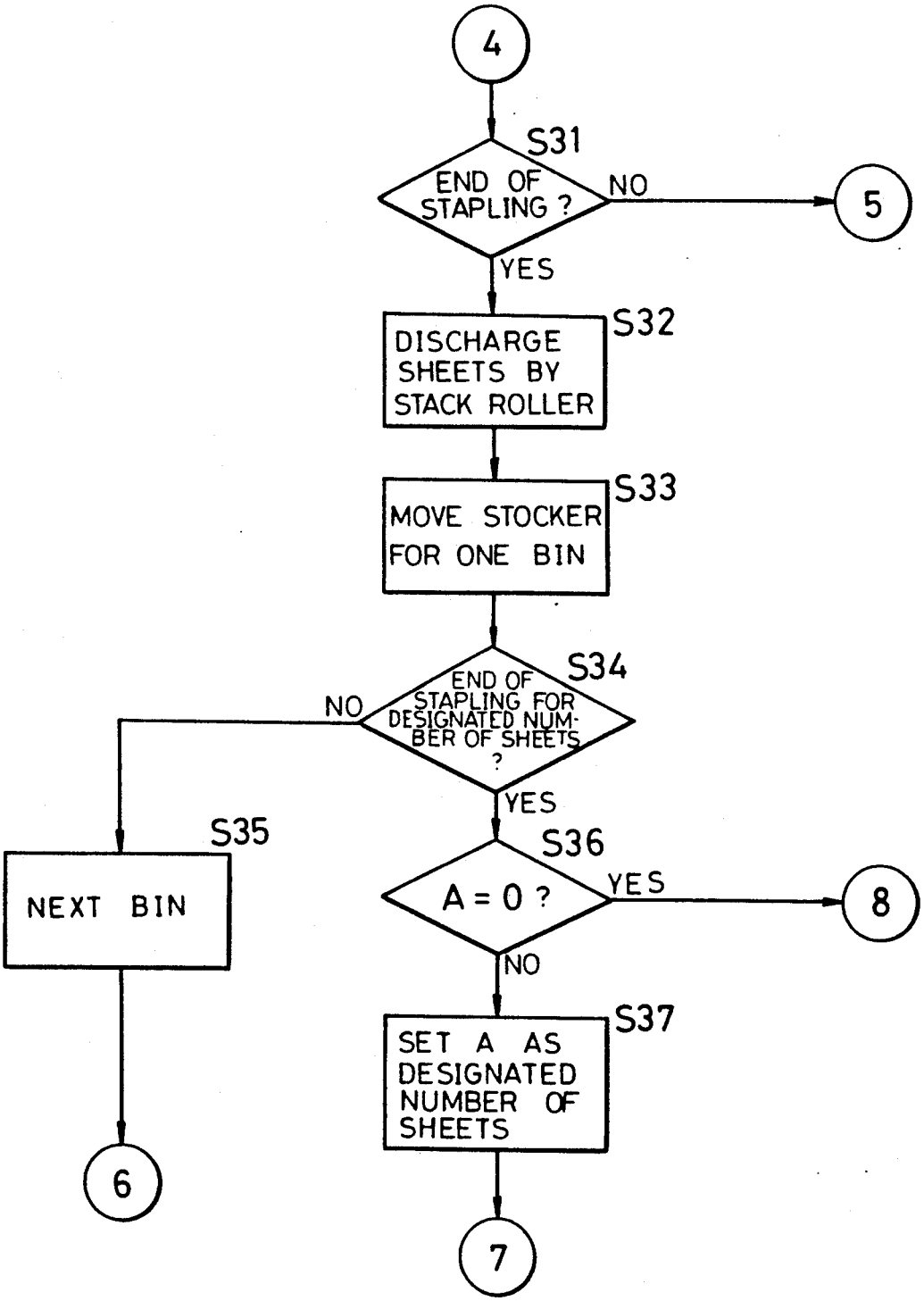

If the designated number of stacks of sheets have been stapled, the program proceeds from step S34 to step S36. At step S36, it is determined whether the difference "A" obtained at step S8 of FIG. 15A is "0" or not. If "A" is not "0", the program proceeds to step S37. At step S37, "A" is reset to the designated number of sheets, and the program returns to step S7 to repeat the above-described operations.

If it is determined that "A" is "0", the program returns to step S1 of FIG. 15A, whereby the respective components are reset to their initial conditions to await the start instruction for a subsequent process.

In the above description of the flow charts, the control of the movement operation of the stocker 81 appears only at step S33. In this case, the stock tray 28 lowers by an amount corresponding to one bin. The movement operation of the stocker 81 is also controlled in the manner described below, in conjunction with the control process at step S33.

The sensors 82 continually detect the presence of a given quantity of stacks of sheets in the stock tray 28. When the sensors 82 detect stacks even if the stock tray 28 has been lowered by the amount corresponding to one bin at step S33, the stock tray 28 is further lowered by a predetermined amount. This operation is repeated until the sensors 82 make no further detection. When the stock tray 28 has lowered to its lowest position and thereby activated the limit switch 83, the sorter control unit 101 determines that the stock tray 28 is full. Then, the control unit 101 transmits a signal indicating the full state to the copying machine body control unit 100. As a result, a display on the operation panel of the copying machine body 1 switches on to indicate the full state of the stock tray 28.

Modifications a. Although the stock tray 28 is lowered at step S33 of FIG. 15D in the above-described embodiment relative to one bin each time a stack of sheets is received, the stock tray 28 may be lowered after the detection of a predetermined quantity of sheets on the tray 28.

b. Although the stapler is provided as an apparatus for handling sheets received from the copying machine body 1 in the above-described embodiment, other apparatus, such as a punching unit, may be provided.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A sheet handling apparatus for handling sheets discharged from an image forming apparatus provided adjacent to said apparatus, said apparatus comprising:

a sheet storer for storing the sheets discharged from said image forming apparatus, said sheet storer being conveyable in a sheet width direction perpendicular to a sheet supplying direction;

a supply mechanism provided between said image forming apparatus and said sheet storer for supplying the sheets from said image forming apparatus to said sheet storer;

a processing mechanism for carrying out a predetermined process upon the sheets stored in said sheet storer;

a discharge mechanism for discharging the sheets processed by said processing mechanism from said sheet storer to a region frontward with respect to said image forming apparatus, where an operator normally stands, said discharge mechanism being a mechanism for transporting the sheets while nipping them, and said processing mechanism being located in a position so as to enable it to process the sheets while they are nipped by said discharge mechanism;

a stacker provided alongside the front of said image forming apparatus for storing the sheets discharged by said discharge mechanism;

control means for controlling said discharge mechanism and said processing mechanism in order that said processing mechanism processes the sheets while they are nipped by said discharge mechanism; and means for controlling conveyance of said sheet storer in order to place the sheets in said sheet storer into a nipping position of said discharge mechanism.

2. An apparatus according to claim 1, wherein said sheet storer is vertically conveyable, said apparatus further comprising a plurality of vertically conveyable sheet storers other than said sheet storer, and a drive mechanism for vertically conveying said plurality of sheet storers.

3. An apparatus according to claim 2, wherein said stacker is vertically movable, said apparatus further comprising means for controlling a position of said stacker in dependency on the quantity of sheets stored in said stacker.

4. An apparatus according to claim 3, wherein said processing mechanism is located adjacent to the lower end of said sheet storer.

5. An apparatus according to claim 1, wherein sheet storer is sloped such than an end thereof, onto which the leading edges of sheets are received, is higher than the opposite end thereof, onto which the trailing edges of sheets arrive, and said sheet storer has a sheet stop along its lower end for checking the movement of the sheets.

6. A sheet handling apparatus for handling sheets discharged from an image forming apparatus provided adjacent to said apparatus, said apparatus comprising:

a sheet storer for storing the sheets discharged from said image forming apparatus, said sheet storage being conveyable both vertically and in a sheet width direction perpendicular to a sheet supplying direction;

a stapler for stapling the sheets stored in said sheet storer; and control means for controlling conveyance of said sheet storer so as to set a predetermined positioning of the sheets in said sheet storer to be coincident with a stapling position of the stapler.

7. An apparatus according to claim 6, further comprising a discharge mechanism at a frontward end in the moving range of said sheet storer, for discharging the sheets from said sheet storer.

8. An apparatus according to claim 7 further comprising a stacker located alongside the front of said image forming apparatus, for storing the sheets discharged by said discharge mechanism.

9. An apparatus according to claim 8, wherein said discharge mechanism is a mechanism for transporting the sheets through nipping them, said apparatus further comprising first control means for controlling the operation of said stapler and said discharge mechanism in order to staple the sheets while they are nipped by said discharge mechanism.

10. An apparatus according to claim 9, further comprising second control means for controlling sheet discharge of said discharge mechanism and operation of said stapler to thereby staple the sheets at a predetermined position.

11. A sheet handling apparatus for handling sheets discharged from an image forming apparatus, said apparatus comprising:

a sheet storer for storing the sheets discharged from said image forming apparatus;

a stapler for stapling the sheets stored in said sheet storer;

a discharge mechanism for discharging the sheets from said sheet storer through nipping said sheets; and control means for controlling said stapler and said discharge mechanism to staple the sheets while they are nipped by said discharge mechanism.

12. An apparatus according to claim 11, wherein said sheet storer is conveyable in a width direction perpendicular to a sheet supplying direction, said apparatus further comprising means for controlling conveyance of said sheet storer, to effect thereby that the sheets in said sheet storer are in a nipping position of said discharge mechanism.

13. An apparatus according to claim 12, wherein said discharge mechanism is located at an end of the range of movement of said sheet storer through the front side of said image forming apparatus, where an operator normally stands, and a stacker is located further frontward than said discharge mechanism.

14. An apparatus according to claim 13, wherein said discharge mechanism includes a lower roller shaft onto which a plurality of rollers are mounted, an upper roller shaft onto which a plurality of rollers are mounted, said upper roller shaft being movable near to and away from said lower roller shaft, and means for moving said upper roller shaft.

* * * * *